US006092689A

United States Patent [19]

Bennett

[11] Patent Number: 6,092,689

[45] Date of Patent: Jul. 25, 2000

[54] BOWL WITH GRIPPING MEANS

[76] Inventor: Krisitn Bennett, 11 Briarcroft Dr., East Hampton, N.Y. 11937

[21] Appl. No.: 09/412,110

[22] Filed: Oct. 5, 1999

[51] Int. Cl.[7] ..... B65D 25/00

[52] U.S. Cl. ..... 220/729; 220/574; 220/634; 220/752

[58] Field of Search ..... 220/729, 752, 220/574, 600, 603, 634, 573.1, 573.3

[56] References Cited

U.S. PATENT DOCUMENTS

| | | | |
|---|---|---|---|
| 1,909,028 | 5/1933 | Waite | 220/634 |
| 1,938,909 | 12/1933 | Huff | 220/574 |
| 2,647,678 | 8/1953 | Olson | 220/574 X |
| 3,143,242 | 8/1964 | Mulder | 220/634 |
| 3,504,832 | 4/1970 | Corvetti | 220/574 X |

*Primary Examiner*—Steven Pollard

[57] ABSTRACT

A bowl with gripping means comprises an interior surface and exterior surface, a generally cylindrical base portion extending downwardly from a bottom exterior surface of the bowl, the base portion allowing the bowl to rest upon a flat surface in a secure manner, the base portion extending around the outer periphery of the bottom of the bowl and creating a cavity within an inner portion thereof. In the preferred mode, at least one bar extends radially across the bottom of the bowl from a first point upon the generally cylindrical base portion to a second point upon the generally cylindrical base portion, the bar functioning to allow a user to securely grip the bar while tilting the bowl over and removing contents from the interior of the bowl. In an alternate mode of manufacture, the generally cylindrical base portion comprises a plurality of apertures around the periphery thereof, the apertures also functioning to allow a user to securely grip the bowl while tilting the bowl over and removing contents from the interior of the bowl.

16 Claims, 2 Drawing Sheets

BOWL WITH GRIPPING MEANS

BACKGROUND OF THE INVENTION

1. Field of the Invention

The present invention is a bowl having a handle or gripping means located at a recessed portion of the bottom or base. In the preferred mode, the handle is in the form of a bar extending across the bottom of the bowl, enabling the user to hold the bowl with one hand while tilting the bowl for effective cleaning, scraping, or emptying of the contents thereof. In an alternate method of manufacture, the gripping means may consist of multiple holes located around an outer ring around the bottom of the bowl. In any such instance, the handle provides for more convenient overall usage of the bowl, while still maintaining a desired appearance of the item.

2. Description of the Prior Art

Numerous innovations for bowl devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1) U.S. Pat. No. 5,169,023, invented by Heiberg et al., titled "Tilting Mixing Bowl"

The patent to Heiberg et al. describes a mixing bowl of generally arcuate configuration and including laterally spaced stabilizing ribs extending along the outer surface thereof between the base and a mouth-defining rim. The ribs, upon an inclination of the bowl, continuously define a laterally extending support plane. The interior of the bowl is of a hard smooth material while the exterior thereof is of a non-slip friction-enhancing material. The open mouth of the bowl is surrounded by an outwardly flaring rim with a grip-enhancing undersurface.

2) U.S. Pat. No. 5,419,454, invented by Stowell, et al., titled "Mixing Bowl"

The patent to Stowell, et al. describes a mixing bowl has a unitary inner shell including a circular base and a peripheral side wall extending upwardly therefrom to an upper peripheral rim defining the open mouth of the bowl, the side wall having a spout at one side thereof and, diametrically opposite thereto, a laterally outwardly extending two-part handle, including an upper part unitary with the inner shell of the bowl and a lower part fixed thereto. The handle has a compound upper surface and a recessed lower surface to facilitate grasping. The base and the lower portion of the peripheral side wall have the outer surfaces thereof covered with an outer shell of frictional material.

3) U.S. Pat. No. 5,203,836, invented by Brazis, et. al., titled "Nestable Mixing Bowl with Integral Handle"

In the patent to Brazis, et al., a mixing bowl set is disclosed comprising nestable bowls, each having a radiussed sidewalls, and a downturned upper rim flange. The rim flange has a lower edge which is spaced apart from the sidewall a distance which varies from a maximum at the rearward end of the bowl to a minimum at the forward end (26). Accordingly, a channel is defined below the rim flange which is wider at the rearward end, sufficiently so to admit the digits of a hand, whereby making the rearward portion of the flange a handle for the bowl. A pourspout is provided in the forward end of the rim flange and is configured to be entirely below flange. Accordingly, there are no projections beyond the rim flange of the bowl throughout its entire circumference which could interfere with the nesting of one bowl into a like-configured larger bowl.

4) U.S. Pat. No. 5,423,452 invented by Tardif, titled "Mixing Bowl"

The patent to Tardif describes an open top mixing bowl of generally semi-spherical form having hand grip means extending from its upper rim opposite a wide pouring spout and a plurality of concentric axially spaced anti-skid rings projecting outwardly of the lower exterior of the bowl to provide stable support to the bowl in its normal upright and tilted positions of operation.

5) U.S. Pat. No. 5,392,948, invented by McEntee, titled "Mixing Bowl"

The patent to McEntee is a nestable, stackable mixing bowl is provided having a radiused sidewall and a wide concave rim flange. The rim flange provides a handle around the entire circumference of the bowl, providing an easy way to grasp the bowl while pouring. The rim flange is provided with three integral equidistantly spaced pourspouts, thus requiring less manipulation for positioning the bowl for pouring. The bottom of the bowl is provided with an annular rib to provide stability to the bowl. The bowl is also provided with a lid shaped to cover the bowl and to accept the rim flange. The lid has a central circular depressed portion sized to matingly engage the bottom rib of a smaller capacity bowl, providing stable stacking.

6) U.S. Pat. No. 3,198,377, invented by Buckley, titled "Mixing Bowl with Handle"

This invention to Buckley relates to a cooking vessel and more particularly to a vessel which can be handled conveniently with one hand of the user while the other hand is otherwise occupied.

Design Patents

7) U.S. Pat. No. D347,969, invented by Cousins et al., entitled "Bowl with Handle"

In the patent to Cousins et al., an ornamental design for a bowl with handle, is shown and described.

8) U.S. Pat. No. D255,206, invented by Darnell, entitled "Preparation Bowl"

In the patent to Darnell an ornamental design for a preparation bowl is shown and described.

9) U.S. Pat. No. D385,462, invented by Ferris, entitled "Clip-On Bowl"

In the patent to Ferris, an ornamental design for a clip-on bowl is shown and described.

As outlined above, the prior art patents that relate to improved mixing bowls largely entail elements such as: bowls with attachable and detachable side handles; bowls that feature improved stacking ability; bowls that have indentations in the sides for ease in carrying across a room; and bowls that better balance upon a flat surface when slightly tipped to the side.

In contrast to the patents uncovered in the search, the present invention is a mixing bowl with a handle located at a bottom portion, blocked from view when set down on a flat surface in the preferred from of production. The gripping means uniquely allows the user to turn the bowl over, for enhanced convenience in cleaning out the bowl, even if the bowl is substantially heavy in weight.

SUMMARY OF THE INVENTION

As previously noted, the present invention is a bowl having a handle or gripping means located at a recessed portion of the bottom or base. In the preferred mode, the handle is in the form of a bar extending across the bottom of the bowl, enabling the user to hold the bowl with one hand while tilting the bowl for effective cleaning, scraping, or emptying of the contents thereof. In an alternate method of manufacture, the gripping means may consist of multiple holes located around an outer ring around the bottom of the bowl. In any such instance, the handle provides for more convenient overall usage of the bowl, while still maintaining a desired appearance of the item.

In particular, the bowl of the present invention is designed to help persons, and particularly bakers, in scraping out the contents of a bowl. The addition of handles or gripping apertures appearing at the bottom portion of the bowl solves the common problem of the bowl being too heavy or too cumbersome to effectively grip with a single hand—a motion necessary for quick and effective emptying of the interior of the bowl.

With the foregoing in mind, one feature taught by the present invention is that the device may utilize a single gripping bar, or multiple gripping bars, according to the size and weight of the bowl itself.

Another feature of the present invention is that varying materials of construction may be utilized for both the bowl itself and for the gripping handles used.

Another feature of the present invention is that the device may be designed in an aesthetically pleasing manner, as the cylindrical lip or base portion will block the gripping handles from view when the bowl is placed upon a flat surface. In addition, decorative indicia may appear upon the exterior surface of the bowl.

Still another feature of the present invention is that the device allows for an alternate embodiment, wherein a plurality of gripping holes, of varying quantity or shapes, is included around the base portion for effective gripping with one hand.

Another feature of the present invention is that the handles may include a cover portion functioning to protect the user from heat emanating therefrom, for increased overall effectiveness.

With regards to the versatility of the invention, the device may be utilized in combination with traditional mixing bowls, or any other similarly shaped bowl or item, wherein at least one handle may be placed at a bottom portion thereof.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
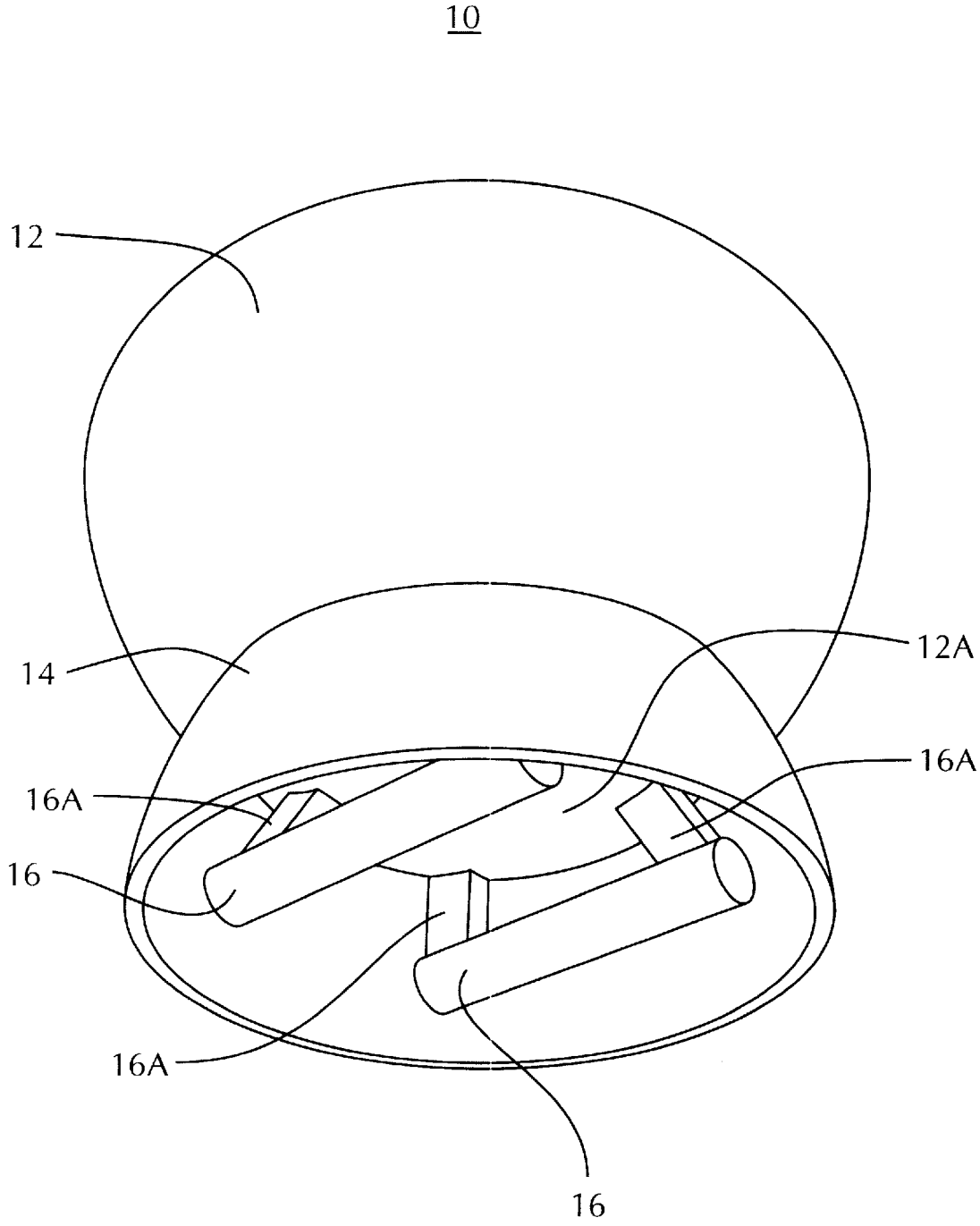
FIG. 1 is a three-quarter perspective view of the present invention, illustrated with two parallel handles located at the bottom of the bowl, for the purposes of example.

Firstly, referring to FIG. 1, which is a three-quarter perspective view of the present invention, illustrated with two parallel handles located at the bottom of the bowl, for the purposes of example:

Illustrated is the bowl with gripping means-primary embodiment (10), which comprises a body portion (12), body portion underside (12A), base portion (14), handle (16), handle support member (16A).

The bowl with gripping means firstly comprises an interior surface (inside of the bowl) and exterior surface. A generally cylindrical base portion extends downwardly from a bottom exterior surface of the bowl. This base portion acts as an annular lip around the bowl, allowing the bowl to rest upon a flat surface in a secure manner. The base portion extends around the outer periphery of the bottom of the bowl and creates a cavity within an inner portion thereof, as the lower portion of the lip touches the flat surface upon which the bowl is placed, but the bottom portion of the bowl itself does not.

Importantly, at least one bar member extends radially across the bottom of the bowl from a first point upon the generally cylindrical base portion to a second point upon the generally cylindrical base portion. In the preferred mode, the bar is attached to the underside of the bowl by vertical support members extending downwardly from the bottom exterior of the bowl surface.

The bar or bars function to allow a user to securely grip the bar with a single hand while tilting the bowl over for the purpose of removing contents from the interior of the bowl. This solves a common problem of the baker or other user needing to place a thumb of one hand within the interior portion of the bowl, around its upper peripheral edge, in order to have any effective leverage with which to tilt the bowl to its side.

With such in mind, the present invention may utilize two or more gripping bars, for the utmost in leverage and stability. In the preferred mode of production, both gripping bars would be parallel to one another for secure grasping purposes and simplicity of manufacture.

In an alternate mode of production, however, the bowl comprises multiple gripping bars configured in a grid-like pattern. This functions to allow the user to effectively grasp the bottom portion of the bowl, with one hand, regardless of the position the bowl is facing.

In any such instance, the bowl may be manufactured from a material selected from the group consisting of ceramic, formica, plastic, metal, carbon-graphite, and composite, or any other element or compound common to production of bowls and the like.

With that said, the bowl may be manufactured in a traditional generally cylindrical shape, but may also be configured in a generally oval shape, or any other shape and configuration that still allows for the gripping bars to function effectively.

It is also important to note that the bowl may manufactured in a variety of sizes. This is particularly significant in that larger and heavier bowls are traditionally more inconvenient to empty or clean, based upon the difficulty in holding same with one hand when the bowl is in tilted position. As such, the greatest utility of the present invention lies in its application to such heavier bowls, and particularly mixing-type bowls.

Furthermore, the base portion or lip portion of the present invention may be manufactured in a variety of sizes, each providing sufficient vertical height to encase the gripping bars and block the gripping bars from the side perspective view. Regarding same, the base portion has been shown in the FIGURES in a relatively large width for the purposes of example and clear illustration.

In regards to the gripping bars or handles themselves, such may be coated in such a manner as to protect the user from heat emanating therefrom and may also be cushioned for the purposes of enhanced comfort and effectiveness. In an alternate form of manufacture, the gripping handles may even be removably attached to the underside of the bowl, giving the user the ability to lessen the weight of the product or to clean the handles in the most effective fashion.

Figure 2:
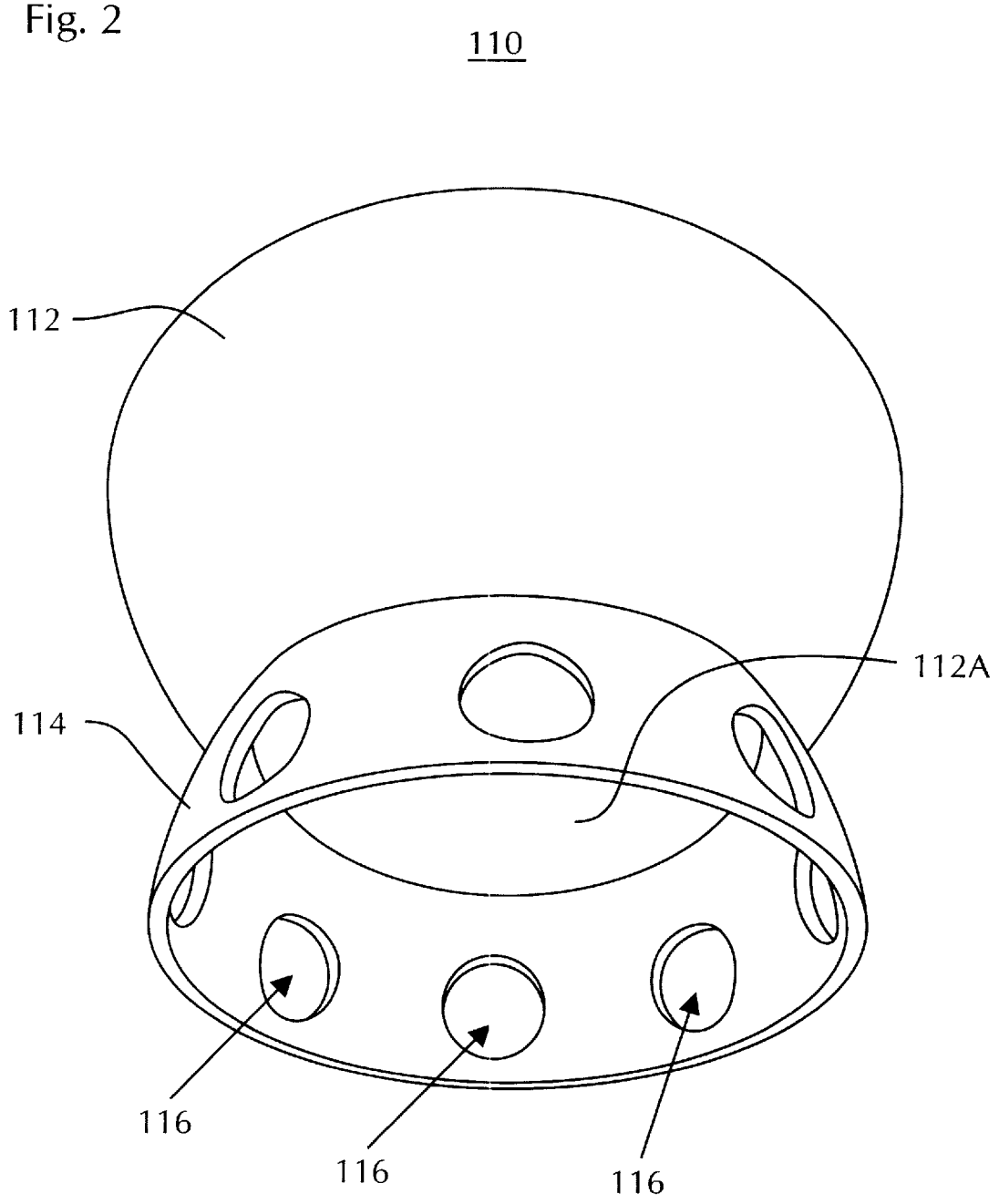
FIG. 2 is a three-quarter perspective view of the present invention, illustrated with multiple handle apertures located around the periphery of the base portion of the bowl, for the purposes of example.

Next, referring to FIG. 2, which is a three-quarter perspective view of the present invention, illustrated with multiple handle apertures located around the periphery of the base portion of the bowl, for the purposes of example:

Illustrated is the bowl with gripping means—alternate embodiment (110), body portion (112) body portion underside (112A), base portion (114), and apertures (16).

The bowl with gripping means again comprises an interior surface and exterior surface. Once again, a generally cylindrical base portion extends downwardly from a bottom exterior surface of the bowl. The base portion or annular lip allows the bowl to rest upon a flat surface in a secure manner. As noted above, the base portion extends around the outer periphery of the bottom of the bowl and creates a cavity within an inner portion thereof.

More importantly, the base portion in this embodiment comprises a plurality of apertures around the periphery thereof. The apertures functioning to allow a user to securely grip the bowl while tilting the bowl over and removing contents from the interior of the bowl. Specifically, the user may insert a finger in each gripping hole aperture, grasp the bowl securely in one hand, and tilt the bowl over, while using the available hand to scrape out its contents.

To accomplish the foregoing, the apertures will be rounded in the preferred form of production, but may be cut out in various additional shapes for the purposes of effective gripping or aesthetic value. In any such instance, it is the intention of this embodiment to allow a user to place his or her hand underneath the bowl's bottom surface, with palm facing the underside of the bowl, and place the fingers through at least two of the available apertures for a secure grip of the bowl. With such in mind, this alternate embodiment is particularly useful for bowls of a medium or small size, which will allow the user to grasp the outer periphery of the lip portion easily. In addition, this embodiment can be expected to produce a bowl that is lighter in overall weight than that described in connection with FIG. 1, as less materials of construction will be utilized to accomplish its intended purposes.

With regards to all FIGURES, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A bowl with gripping means comprising:

A. an interior surface and exterior surface;

B. a generally cylindrical base portion extending downwardly from a bottom exterior surface of the bowl, the base portion allowing the bowl to rest upon a flat surface in a secure manner, the base portion extending around the outer periphery of the bottom of the bowl and creating a cavity within an inner portion thereof; and C. at least one bar extending radially across the bottom of the bowl from a first point upon the generally cylindrical base portion to a second point upon the generally cylindrical base portion, the bar functioning to allow a user to securely grip the bar while tilting the bowl over and removing contents from the interior of the bowl.

2. The bowl with gripping means as described in claim 1, wherein the bowl comprises two gripping bars.

3. The bowl with gripping means as described in claim 1, wherein the bowl comprises two gripping bars generally parallel to one another.

4. The bowl with gripping means as described in claim 1, wherein the bowl comprises multiple gripping bars configured in a grid-like pattern.

5. The bowl with gripping means as described in claim 1, wherein the bowl is manufactured from a material selected from the group consisting of ceramic, formica, plastic, metal, carbon-graphite, and composite.

6. The bowl with gripping means as described in claim 1, wherein the bowl is manufactured in a generally cylindrical shape.

7. The bowl with gripping means as described in claim 1, wherein the bowl is manufactured in a generally oval shape.

8. The bowl with gripping means as described in claim 1, wherein the bowl is manufactured in a variety of sizes.

9. The bowl with gripping means as described in claim 1, wherein the base portion is manufactured in a variety of sizes, each providing sufficient vertical height to encase and the gripping bars and block the gripping bars from side perspective view.

10. The bowl with gripping means as described in claim 1, wherein the gripping bars are removably attached to the underside of the bowl.

11. The bowl with gripping means as described in claim 1, wherein the bowl bears decorative indicia upon the exterior surface thereof.

12. The bowl with gripping means as described in claim 1, wherein the gripping bars are not visible when the bowl is placed upon a flat surface.

13. The bowl with gripping means as described in claim 1, wherein the bowl utilized is a mixing bowl.

14. The bowl with gripping means as described in claim 1, wherein the gripping bars are coated to protect the user from heat emanating therefrom.

15. The bowl with gripping means as described in claim 1, wherein the gripping bars are cushioned for enhanced comfort and effectiveness.

16. A bowl with gripping means comprising:

A. an interior surface and exterior surface;

B. a generally cylindrical base portion extending downwardly from a bottom exterior surface of the bowl, the base portion allowing the bowl to rest upon a flat surface in a secure manner, the base portion extending around the outer periphery of the bottom of the bowl and creating a cavity within an inner portion thereof, and the base portion comprising a plurality of apertures around the periphery thereof, the apertures functioning to allow a user to securely grip the bowl while tilting the bowl over and removing contents from the interior of the bowl.

* * * * *